US012037689B2

(12) United States Patent
Miwa et al.

(10) Patent No.: US 12,037,689 B2
(45) Date of Patent: Jul. 16, 2024

(54) GALVANIZED MEMBER

(71) Applicant: Nippon Telegraph and Telephone Corporation, Tokyo (JP)

(72) Inventors: Takashi Miwa, Tokyo (JP); Azusa Ishii, Tokyo (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 696 days.

(21) Appl. No.: 17/256,924

(22) PCT Filed: Jun. 28, 2019

(86) PCT No.: PCT/JP2019/025824
§ 371 (c)(1),
(2) Date: Dec. 29, 2020

(87) PCT Pub. No.: WO2020/009019
PCT Pub. Date: Jan. 9, 2020

(65) Prior Publication Data

US 2021/0285082 A1 Sep. 16, 2021

(30) Foreign Application Priority Data

Jul. 2, 2018 (JP) ..... 2018-125872

(51) Int. Cl.

| | |
|---|---|
| ***C23C 2/04*** | (2006.01) |
| ***C23C 2/02*** | (2006.01) |
| ***C23C 2/28*** | (2006.01) |
| ***C23G 1/08*** | (2006.01) |

(52) U.S. Cl.
CPC ..... *C23C 2/04* (2013.01); *C23C 2/024* (2022.08); *C23C 2/29* (2022.08); *C23G 1/08* (2013.01)

(58) Field of Classification Search
None
See application file for complete search history.

(56) References Cited

U.S. PATENT DOCUMENTS 3,712,826 A * 1/1973 Kimuro ..... C23C 2/06 427/205
2017/0145551 A1 5/2017 Giordani et al.

FOREIGN PATENT DOCUMENTS

JP 2017521559 A 8/2017

OTHER PUBLICATIONS

Langill, "Continuous Sheet Galvanizing (G60, G90) vs. Batch Hot-Dip Galvanizing", Dec. 1, 2010, American Galvanizers Association, accessed online Oct. 2, 2023 at galvanizeit.org/knowlegdebase/article/continuous-sheet-galvanizing-production-process (Year: 2010).*

(Continued)

*Primary Examiner* — Kim S. Horger
(74) *Attorney, Agent, or Firm* — Slater Matsil, LLP

(57) ABSTRACT

The galvanized member includes a member formed of a metal and a hot-dip galvanized layer formed on the surface of the member. The hot-dip galvanized layer contains a sulfate salt having a higher water solubility than calcium sulfate. A sulfate salt content of the hot-dip galvanized layer is preferably 0.008 to 0.133 mol based on 100 g of zinc. The sulfate salt contained in the hot-dip galvanized layer is preferably at least one of potassium sulfate, sodium sulfate, magnesium sulfate, calcium sulfate, ferric sulfate, ferrous sulfate, lithium sulfate, calcium sulfate, and aluminum sulfate.

20 Claims, 1 Drawing Sheet

(56) References Cited

OTHER PUBLICATIONS

M. Matsumoto, "Corrosion Behavior of Steel and Zinc in Cyclic Corrosion Tests," Proceedings of the 4th International Conference on Zinc and Zinc Alloy Coated Steel Sheet (Galvatech '98), Sep. 20-23, 1998, 6 pages.
N. S. Azmat et al., "Corrosion of Zn under acidified marine droplets," Elsevier, Corrosion Science 53, 2001, 12 pages.
T. Miwa et al. "Various Accelerated Corrosion Tests and Outdoor Exposure Tests Using Coated Steel Sheets", Tech Nicals Report, 2017, 15 pages.
The Japan Iron and Steel Federation, "Corrosion Resistance of Hot-Dip Galvanizing, 3. Corrosion Resistance in the atmosphere," Study Group on Galvanized Steel Structure, (https://jlzda.gr.jp/mekki/pdf/youyuu.pdf), Jun. 27, 2018, 7 pages.
The Japan Iron and Steel Federation, "Corrosion Resistance of Hot-Dip Galvanizing, 6. Corrosion Resistance in Water," Study Group on Galvanized Steel Structure, (https://jlzda.gr.jp/mekki/pdf/youyuu.pdf), Jun. 27, 2018, 9 pages.

* cited by examiner

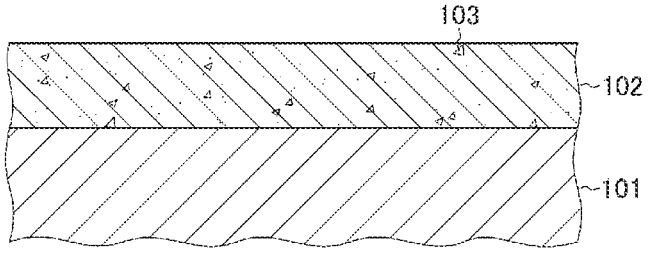
103
102
101

GALVANIZED MEMBER

CROSS-REFERENCE TO RELATED APPLICATIONS

This application is a national phase entry of PCT Application No. PCT/JP2019/025824, filed on Jun. 28, 2019, which claims priority to Japanese Application No. 2018-125872 filed on Jul. 2, 2018, each of which is hereby incorporated herein by reference.

TECHNICAL FIELD

The present invention relates to a galvanized member galvanized by hot-dip galvanization or the like.

BACKGROUND

Among the plating techniques for protecting a member formed of a metal such as steel from corrosion, galvanization involving zinc as a plating material is widely used. For steel structures to be used outdoors for a long period of time, in particular, hot-dip galvanization is used that enables formation of a thick plated layer and causes the plated layer to firmly adhere to the substrate by forming a steel-zinc alloy layer at the boundary with the substrate steel product.

In galvanization, corrosion of zinc results in the formation of a protective corrosion product, and thus the corrosion rate is decreased. The corrosion rate of zinc is 1/22.6 on average as compared with steel in the case of atmospheric corrosion, thus giving a long life (see Non-Patent Literature 1).

Moreover, also in the case where the plated layer is damaged and the substrate steel product is exposed, sacrificial anticorrosive action is exerted on metals that are more noble than zinc, also zinc ions eluted from zinc form a zinc corrosion product on the exposed part, this corrosion product serves as a protective film, and thus the superior effect of suppressing corrosion of the exposed part of the substrate metal (protective film action) is obtained.

CITATION LIST

Non-Patent Literature

Non-Patent Literature 1: M. Matsumoto, "Corrosion Behavior of Steel and Zinc in Cyclic Corrosion Tests", Proceedings of the 4th International Conference on Zinc and Zinc Alloy Coated Steel Sheet (GALVATECH '98), pp. 404-409, 1998.

Non-Patent Literature 2: Study Group on Galvanized Steel Structure, "Corrosion Resistance of Hot-Dip Galvanization, 3. Corrosion Resistance in Air" [searched on Jun. 27, 2019] (https://jlzda.gr.jp/mekki/pdf/youyuu.pdf).

Non-Patent Literature 3: Takashi Miwa, Yukitoshi Takeshita, Azusa Ishii, "Technical Report, Comparison of Corrosion Behaviors by Various Accelerated Corrosion Tests and Outdoor Exposure Tests Involving Coated Steel Sheet", Rust Prevention & Control Japan, 61, 12, pp. 449-455, 2017.

Non-Patent Literature 4: N. S. Azmat et al., "Corrosion of Zn under acidifind marine droplets", Corrosion Science, vol. 53, pp. 1604-1615, 2011.

Non-Patent Literature 5: Study Group on Galvanized Steel Structure, "Corrosion Resistance of Hot-Dip Galvanization, 6. Corrosion Resistance in Water" [searched on Jun. 27, 2018] (https://jlzda.gr.jp/mekki/pdf/youyuu.pdf).

SUMMARY

Technical Problem

As described above, concerning galvanization, when zinc of the plated layer corrodes, a protective corrosion product is formed, thus the corrosion rate is decreased, and the corrosion rate in the case of atmospheric corrosion is 1/22.6 on average as compared with steel, thus giving a long life (see Non-Patent Literature 1). However, corrosion of plated zinc proceeds at an average corrosion rate of 4.5 g/m$^2$/year in a mildly corroding environment such as a rural area, and at an average corrosion rate of 11.1 g/m$^2$/year in an area affected by airborne salts (a salt damaged area) such as a coastal area (Non-Patent Literature 2). Since 11.1 g/m$^2$/year is an average value, plated zinc corrodes at a higher rate in a particularly severe environment in salt damaged areas.

As the plated layer wears on, the iron-zinc alloy layer is exposed, and red rust is produced. When corrosion further proceeds to the steel substrate, it is necessary to perform rust removal (substrate conditioning) and then repairs such as coating. Since outdoor galvanized steel structures are desirably maintenance-free for a long period of time, generally a thick plated layer such as HDZ55 (550 g/m$^2$) is formed by hot-dip galvanization. However, even when such a thick plated layer is formed, the iron-zinc alloy layer may be exposed and require coating in less than 10 years in a particularly severe environment in salt-damaged areas.

Accordingly, demand exists for longer-life galvanization. For example, zinc alloy plating is achieved by adding a small amount of aluminum (up to 10%) or magnesium (up to 3%) to zinc to reduce the corrosion rate to about 1/2 to 1/3. The plated layer resulting from such zinc alloy plating has a corrosion rate reduced to about 1/2 to 1/3 of the plated layer provided by ordinary galvanization, and thus has a longer life than the plated layer provided by galvanization when the plated layers have the same thickness. However, with zinc alloy plating, it is more difficult to provide a thick plated layer than galvanization, and it is only possible to form a plated layer having a thickness that is about 60 to 70% of a layer provided by galvanization. Accordingly, even when the corrosion rate is reduced to 1/2 to 1/3, a two or three-times longer life is not obtained. Even in this state, a longer life is attained than ordinary galvanization, but since the introduction cost is higher than that of ordinary galvanization, the advantage with respect to life cycle cost is not so great.

Embodiments of the present invention have been conceived to solve such problems, and an object of embodiments of the present invention is to reduce at lower cost the corrosion rate of a plated layer provided by galvanization.

Means for Solving the Problem

The galvanized member according to embodiments of the present invention includes a member formed of a metal and a hot-dip galvanized layer formed on the surface of the member, wherein the hot-dip galvanized layer contains a sulfate salt having a higher water solubility than calcium sulfate.

In the galvanized member, a sulfate salt content of the hot-dip galvanized layer is preferably 0.008 to 0.133 mol relative to 100 g of zinc.

In the galvanized member, the sulfate salt contained in the hot-dip galvanized layer is preferably at least one of potassium sulfate, sodium sulfate, magnesium sulfate, calcium sulfate, ferric sulfate, ferrous sulfate, lithium sulfate, and aluminum sulfate.

In the galvanized member, the member is a steel product.

Effects of Embodiments of the Invention

As described above, according to embodiments of the present invention, the hot-dip galvanized layer contains a sulfate salt, and thus a superior effect that the corrosion rate of the plated layer provided by galvanization can be reduced at lower cost is obtained.

BRIEF DESCRIPTION OF THE DRAWING

FIG. 1 is a cross-sectional view showing the configuration of a galvanized member according to an embodiment of the present invention.

DETAILED DESCRIPTION OF ILLUSTRATIVE EMBODIMENTS

Below, a galvanized member according to an embodiment of the present invention will now be described with reference to FIG. 1. This galvanized member includes a member 101 formed of a metal and a hot-dip galvanized layer 102 formed on the surface of the member 101. The member 101 is, for example, a steel product. The hot-dip galvanized layer 102 is prepared by well-known hot-dip galvanization. In embodiments of the present invention, the hot-dip galvanized layer 102 contains a sulfate salt having a higher water solubility than calcium sulfate. In the hot-dip galvanized layer 102, for example, fine particles 103 of a sulfate salt powder are dispersed.

The sulfate salt content in the hot-dip galvanized layer 102 is preferably 0.008 to 0.133 mol based on 100 g of zinc. The sulfate salt contained in the hot-dip galvanized layer 102 is preferably at least one of potassium sulfate, sodium sulfate, magnesium sulfate, calcium sulfate, ferric sulfate, ferrous sulfate, lithium sulfate, and aluminum sulfate.

Below, a more detailed description will now be provided with reference to the results of experiments.

[Experiment 1]

First, Experiment 1 will now be described.

[Sample Preparation]

A zinc bath (a plating bath) of distilled zinc set forth in the standards of "JIS H 8641" was used to disperse a sulfate salt powder in this zinc bath, and hot-dip galvanization was performed on a steel sheet to give a sample of Experiment 1.

More specifically, a SS400 steel plate having a size of 150×70 (mm) as viewed from above and a sheet thickness of 3.2 mm was used. The sulfate salt was magnesium sulfate (anhydrous magnesium sulfate). Six zinc baths obtained by mixing (dispersing) powdered magnesium sulfate in weight ratios of 0 (not added), 1, 2, 4, 8, and 16 to 100 of zinc were provided, and hot-dip galvanization was performed in each zinc bath to prepare six plated samples 1 to 6. Plating treatment was performed through the steps of ordinary hot-dip galvanization, i.e., "a first step of degreasing, a second step of water washing, a third step of acid cleaning, a fourth step of water washing, a fifth step of flux treatment, a sixth step of galvanization, and a seventh step of cooling".

Plated sample 1 is a sample plated in a zinc bath prepared at 0 of magnesium sulfate powder to 100 of zinc.

Plated sample 2 is a sample plated in a zinc bath prepared by mixing/dispersing magnesium sulfate powder in a weight ratio of 1 to 100 of zinc.

Plated sample 3 is a sample plated in a zinc bath prepared by mixing/dispersing magnesium sulfate powder in a weight ratio of 2 to 100 of zinc.

Plated sample 4 is a sample plated in a zinc bath prepared by mixing/dispersing magnesium sulfate powder in a weight ratio of 4 to 100 of zinc.

Plated sample 5 is a sample plated in a zinc bath prepared by mixing/dispersing magnesium sulfate powder in a weight ratio of 8 to 100 of zinc.

Plated sample 6 is a sample plated in a zinc bath prepared by mixing/dispersing magnesium sulfate powder in a weight ratio of 16 to 100 of zinc.

A combined cycle test was performed on each of the plated samples 1 to 6, wherein the back surface was sealed with a masking sheet, and salt spraying, wetting, and drying were repeated. Regarding the test conditions of the combined cycle test, the NTT combined cycle test described in Non-Patent Literature 3 was carried out for 240 hours. Note that, as described in Non-Patent Literature 4, when zinc is corroded by seawater, highly protective gordaite is produced due to sulfate ions contained in seawater, but the aqueous sodium chloride solution used in the technology of Non-Patent Literature 3 does not contain sulfate ions, and no gordaite is produced, and, therefore, for accurate performance evaluation of galvanization, the test solution used was not the solution described in Non-Patent Literature 3, but artificial seawater was used.

After the combined cycle test described above was performed, the corrosion product was removed from each of plated samples 1 to 6 with a scraper, then the seal on the back surface was removed with an organic solvent, and derusting was performed in accordance with Reference Table 1 "Method of chemically removing corrosion product" in "JIS Z 2371 Method of Salt Spray Testing". After derusting, the mass was measured with an electronic balance, and the mass decrease (the mass decrease of the hot-dip galvanized layer) from the mass before the combined cycle test was calculated (the average value of N=3) and divided by the area of each of plated samples 1 to 6 to calculate the corrosion weight loss per unit area.

[Experimental Result 1]

The experimental result of Experiment 1 is shown in Table 1 below. In Table 1, "Amount added" is the weight ratio of magnesium sulfate to 100 g of zinc. Compared with galvanization without magnesium sulfate, the hot-dip galvanized layer provided with magnesium sulfate had a reduction in corrosion weight loss of about 15 to 34%.

[Table 1]

TABLE 1

| | Amount added | | | | | |
|---|---|---|---|---|---|---|
| | 0 | 1 | 2 | 4 | 8 | 16 |
| Corrosion weight loss ($g/m^2$) | 13.9 | 11.5 | 10.8 | 9.3 | 9.2 | 11.8 |

When excessive magnesium sulfate is added to the zinc bath, there is a tendency that the corrosion weight loss of the hot-dip galvanized layer obtained by hot-dip galvanization is increased. This is considered to indicate as follows. First, when magnesium sulfate (particles of magnesium sulfate) of the hot-dip galvanized layer dissolves in water, portions where particles of magnesium sulfate were present become depressions. Thus, when depressions are formed in the surface of the hot-dip galvanized layer, the surface area where corrosion occurs is increased. Moreover, since oxygen is unlikely supplied to the inside of depressions, formation of oxygen concentration cells due to irregularities and a decrease in pH inside the depressions occur, and thus corrosion is promoted. From these, it is inferred that the corrosion rate is increased when the sulfate salt is excessively added.

[Experiment 2]

Next, Experiment 2 will now be described.

[Sample Preparation]

In Experiment 2, sodium sulfate was used in place of magnesium sulfate used in Experiment 1, and sodium sulfate powder was dispersed in a zinc bath of distilled zinc, and a steel sheet as used in Experiment 1 received hot-dip galvanization to give a sample of Experiment 2.

More specifically, a zinc bath was prepared wherein sodium sulfate powder was mixed in a weight ratio of 4.73 to 100 of zinc, and hot-dip galvanization was performed in this zinc bath in the same manner as in Experiment 1 to prepare plated sample 7. A combined cycle test as in Experiment 1 was performed on the prepared plated sample 7, also the corrosion product was removed from plated sample 7 with a scraper, then the seal on the back surface was removed with an organic solvent, and derusting was performed. After derusting, the mass was measured with an electronic balance, and the mass decrease from the mass before the combined cycle test was calculated and divided by the area of plated sample 7 to calculate the corrosion weight loss per unit area.

[Experimental Result 2]

Experimental Result 2 of Experiment 2 will be described below. Plated sample 7 that was hot-dip galvanized in a zinc bath obtained by mixing sodium sulfate powder in a weight ratio of 4.73 to 100 of zinc as with plated sample 4 of Experiment 1 had a corrosion weight loss of 11.0 $g/m^2$. In comparison to plated sample 4 (a corrosion weight loss of 9.3 $g/m^2$), while plated sample 4 in which magnesium sulfate was used had a smaller corrosion weight loss (a lower corrosion rate), plated sample 7 in which sodium sulfate was used also had a corrosion weight loss smaller than that of a sample to which no sulfate salt was added (plated sample 1).

From the two experimental results described above, it was found that similar effects can be expected when any water-soluble sulfate salt is used, and that the magnesium salt has a slightly higher anticorrosion effect than the sodium salt.

In plated samples 2 to 6 of Experiment 1, the weight ratios in terms of mole of amounts 1 to 16 of magnesium sulfate added to the zinc bath used range from 0.008 mol to 0.133 mol per 100 g of zinc. Accordingly, this range is desirable also when other sulfate salts are added. Moreover, as shown in Table 1, better results are obtained in amounts added ranging from 2 to 8, and thus the range of 0.016 to 0.066 mol is more desirable per 100 g of zinc.

A possible reason why corrosion resistance was increased by adding magnesium sulfate and sodium sulfate is that a highly anticorrosive protective film of gordaite [$NaZn_4(SO_4)(OH)_6Cl \cdot 6H_2O$] is formed due to zinc ions eluted from zinc powder as well as sodium ions, chloride ions and sulfate ions contained in artificial seawater (≈seawater) (see Non-Patent Literature 4).

It is considered that in salt-damaged areas where sea salt particles become airborne this gordaite is produced on the surface of zinc, and the inventors investigated whether the anticorrosion properties of hot-dip galvanization are increased by intentionally forming a large amount of gordaite. In addition to gordaite, known corrosion products of zinc are chiefly zincite [ZnO], hydrozincite [$Zn_5(CO_3)_2(OH)_6$], and layered zinc hydroxide chloride [simonkolleite, $Zn_5(OH)_8Cl_2 \cdot H_2O$].

Among these, layered zinc hydroxide chloride and gordaite are two corrosion products that are not produced unless chloride ions are present. A zinc corrosion product prepared by corroding zinc with artificial seawater was pulverized with an agate mortar and analyzed by X-ray diffraction (XRD analysis) to determine the ratio of the peak intensity of gordaite (11.0°) to the peak intensity of layered zinc hydroxide chloride)(6.5°) (ratio of gordaite/layered zinc hydroxide chloride). The peak positions used were selected from positions where there were no peaks of other corrosion products nearby.

A zinc corrosion product that was directly subjected to the XRD analysis after being prepared and a zinc corrosion product that was subjected to the XRD analysis after being prepared and then washed with a large amount of pure water for a long period of time were compared. As a result of this comparison, a peak of gordaite appeared from the unwashed sample, and the ratio of gordaite/layered zinc hydroxide chloride was about 1. On the other hand, concerning the washed sample, the peak of gordaite was extremely small, and the gordaite/layered zinc hydroxide chloride ratio was as small as 0.1 which is about 1/10. From these, it was found that gordaite is more soluble in water than layered zinc hydroxide chloride.

From the above results, the inventors presumed the process taking place when zinc is corroded by sea salt particles and then gordaite and layered zinc hydroxide chloride precipitate as follows.

In addition to zinc ions, there are sodium ions, chloride ions, sulfate ions, magnesium ions, and a large number of other seawater-derived ions in the aqueous solution by which zinc is corroded, but chloride ions are present in larger amounts than sulfate ions in seawater, and layered zinc hydroxide chloride is less soluble in water (≈a lower solubility product constant) and more likely precipitates. Accordingly, when this aqueous solution is dried and the concentration of the solution increases, layered zinc hydroxide chloride starts to precipitate first. Due to the precipitation of layered zinc hydroxide chloride, chlorides in the solution are consumed, the ratio of sulfate ions to chloride ions is increased, and after the aqueous solution is further dried and concentrated, gordaite precipitates.

From these, the inventors thought that by supplying sulfate ions also from somewhere other than seawater, the proportion of gordaite is increased, the anticorrosive properties of zinc are enhanced, and the corrosive properties of zinc are reduced, thus enabling deterioration of performance of hot-dip galvanization over time, which is the problem of conventional products, to be reduced, and therefore determined to add a water-soluble sulfate salt (disperse a sulfate salt powder) for hot-dip galvanization.

Normally, a water-soluble salt is electrolytically dissociated to become ions in water and increases the conductivity of water (decreases electric resistance). Accordingly, it is considered that there is the disadvantage of promoting the progress of corrosion. Thus, in the case of adding a water-soluble sulfate salt to hot-dip galvanization, whether the advantage of increasing the ratio of highly protective gordaite is greater than the disadvantage of lowering the solution resistance in a corrosion reaction was not clear until the experimentation of the inventors, therefore it was not thought that adding a sulfate salt to hot-dip galvanization increases corrosion resistance, and this cannot be easily inferred.

Moreover, although it is known that gordaite as a highly protective zinc corrosion product is formed by sulfate ions contained in seawater (Non-Patent Literature 4), it cannot be easily inferred either that, by focusing on the solubility products of layered zinc hydroxide chloride and gordaite and supplying sulfate ions separately from seawater, gordaite is intentionally caused to precipitate in a larger amount than usual to lower the corrosion rate of zinc even at an early stage when only layered zinc hydroxide chloride would precipitate and gordaite would not be formed under the usual conditions (in the presence of only seawater), and thereby deterioration of performance of hot-dip galvanization over time is reduced.

Moreover, when the corrosion rate of zinc is excessively lowered, first, a protective current does not flow through a steel product (iron) portion exposed at the damaged part of the plated layer, and sacrificial anticorrosive action is not exerted; and, second, a supply of zinc ions to the damaged part of the plated layer is reduced, the zinc corrosion product so as to cover the damaged part of the plated layer is not formed, the protective film action also does not function, and anticorrosion properties are impaired.

Accordingly, an excessively lowered zinc corrosion rate is not favorable, and thus a suitable corrosion rate is required. It has been disclosed for the first time hereby and cannot be easily inferred that, when a water-soluble sulfate salt is added (dispersed), although the corrosion rate of zinc in the plated layer provided by hot-dip galvanization becomes lower than that of the conventional products, the corrosion rate enables corrosion of a steel product (iron) portion exposed at the damaged part of the plated layer to be prevented better than when no water-soluble sulfate salt is added.

The sulfate salt used in embodiments of the present invention only should dissolve in water and release sulfate ions when the plated layer provided by hot-dip galvanization corrodes. In general, the temperature of the zinc bath in hot-dip galvanization is 430 to 470° C., and thus most sulfate salts can stably exist as solids without being dissolved (molten) in the zinc bath. Accordingly, a sulfate salt powder can be added to the zinc bath, mixed well and dispersed, and then simply subjected to plating treatment.

The chemical formula of gordaite is $NaZn_4(SO_4)(OH)_6Cl{\cdot}6H_2O$. Na and Cl are abundantly contained in seawater, and since the pH of seawater is weakly alkaline, OH is also relatively abundant. Accordingly, it is considered that by adding "zinc sulfate" capable of supplying the remaining Zn and $SO_4$, gordaite is caused to precipitate most efficiently.

In view of environmental impact and in view of availability at relatively low cost, the sulfate salt suitably used is potassium sulfate, sodium sulfate, magnesium sulfate, calcium sulfate, ferric sulfate, ferrous sulfate, lithium sulfate, aluminum sulfate, and the like.

From the results of Experiment 1 and Experiment 2, it was found that when magnesium sulfate and sodium sulfate are added, magnesium sulfate had a slightly higher anticorrosion effect. The chemical formula of gordaite is $NaZn_4(SO_4)(OH)_6Cl{\cdot}6H_2O$, and magnesium ions are irrelevant to precipitation of gordaite. As set forth in Non-Patent Literature 5, this is considered to be because magnesium salts have a higher zinc corrosion suppressing effect. In Non-Patent Literature 5, calcium salts in addition to magnesium salts are described as suppressing zinc corrosion, and it can be inferred that calcium sulfate is suitably used.

Calcium sulfate has a low water solubility of about 0.2% at 20° C. and is thus capable of supplying sulfate ions little by little over a long period of time as compared to highly water-soluble sulfate salts. Sulfate salts having a water solubility lower than that of calcium sulfate (i.e., poorly soluble) cannot sufficiently supply sulfate ions and is thus not suitable for use in embodiments of the present invention.

In embodiments of the present invention, any water-soluble sulfate salt can be suitably used, and it can be easily inferred that not only a single sulfate salt but also a combination of multiple sulfate salts is added.

There is zinc alloy plating obtained by adding a small amount of aluminum (up to 10%) or magnesium (up to 3%) to zinc to reduce the corrosion rate to about 1/2 to 1/3, and it can be inferred that in embodiments of the present invention a similar effect can be obtained from plating with alloy that contains zinc in a high concentration (zinc alloy plating) in addition to galvanization.

As described above, according to embodiments of the present invention, the hot-dip galvanized layer contains a sulfate salt, and thus the corrosion rate of a plated layer provided by galvanization can be reduced at lower cost.

According to embodiments of the present invention, it is sufficient to add a small amount of a sulfate salt powder to a zinc bath of ordinary hot-dip galvanization, thus a reduced corrosion rate can be achieved at low cost, and the plating thickness can be the same as that of ordinary galvanization. Since the corrosion rate of zinc is lower than that of conventionally used galvanization, steel structures involving this galvanization have a longer life. As a result, embodiments of the present invention enable a reduction of maintenance cost and a reduction of upkeep cost of steel structures.

The present invention is not limited to the embodiments described above, and it is clear that many modifications and combinations can be made by those skilled in the art within the technical concept of the present invention.

REFERENCE SIGNS LIST

101 Member
102 Hot-dip galvanized layer
103 Particle

The invention claimed is:

1. A galvanized member comprising:
a member comprising a metal; and
a hot-dip galvanized layer on a surface of the member, wherein the hot-dip galvanized layer comprises a composition of zinc and a sulfate salt having a water solubility that is higher than or equal to that of calcium sulfate, wherein fine particles of the sulfate salt are dispersed in the zinc, and wherein a sulfate salt content of the hot-dip galvanized layer is 0.008 to 0.133 mol based on 100 g of the zinc.

2. The galvanized member according to claim 1, wherein the sulfate salt contained in the hot-dip galvanized layer comprises at least one of potassium sulfate, sodium sulfate, magnesium sulfate, calcium sulfate, ferric sulfate, ferrous sulfate, lithium sulfate, or aluminum sulfate.

3. The galvanized member according to claim 1, wherein the member is a steel product.

4. The galvanized member according to claim 3, wherein the sulfate salt contained in the hot-dip galvanized layer comprises at least one of potassium sulfate, sodium sulfate, magnesium sulfate, calcium sulfate, ferric sulfate, ferrous sulfate, lithium sulfate, or aluminum sulfate.

5. The galvanized member according to claim 1, wherein the sulfate salt content of the hot-dip galvanized layer is 0.016 to 0.066 mol based on 100 g of the zinc.

6. The galvanized member according to claim 1, wherein the hot-dip galvanized layer consists of the zinc and the sulfate salt.

7. The galvanized member according to claim 1, wherein the hot-dip galvanized layer consists of the zinc, aluminum, and the sulfate salt.

8. The galvanized member according to claim 1, wherein the hot-dip galvanized layer consists of the zinc, magnesium, and the sulfate salt.

9. A galvanized member comprising:

a member comprising a metal; and a hot-dip galvanized layer on a surface of the member, wherein:

the hot-dip galvanized layer comprises a composition of zinc and a sulfate salt having a water solubility that is higher than or equal to that of calcium sulfate;

wherein a sulfate salt content of the hot-dip galvanized layer is 0.008 to 0.133 mol based on 100 g of the zinc; and wherein the hot-dip galvanized layer consists of the zinc and the sulfate salt, consists of the zinc, aluminum, and the sulfate salt, or consists of the zinc, magnesium, and the sulfate salt.

10. The galvanized member according to claim 9, wherein the member is a steel product.

11. The galvanized member according to claim 9, wherein the sulfate salt content of the hot-dip galvanized layer is 0.016 to 0.066 mol based on 100 g of the zinc.

12. A method of forming a galvanized product, the method comprising:

providing a product comprising a metal; and forming a hot-dip galvanized layer on a surface of the product, wherein the hot-dip galvanized layer comprises a composition of zinc and a sulfate salt having a water solubility that is higher than or equal to that of calcium sulfate, wherein fine particles of the sulfate salt are dispersed in the zinc, and wherein a sulfate salt content of the hot-dip galvanized layer is 0.008 to 0.133 mol based on 100 g of the zinc.

13. The method according to claim 12, wherein the sulfate salt contained in the hot-dip galvanized layer comprises at least one of potassium sulfate, sodium sulfate, magnesium sulfate, calcium sulfate, ferric sulfate, ferrous sulfate, lithium sulfate, or aluminum sulfate.

14. The method according to claim 12, wherein the product is a steel product.

15. The method according to claim 14, wherein the sulfate salt contained in the hot-dip galvanized layer comprises at least one of potassium sulfate, sodium sulfate, magnesium sulfate, calcium sulfate, ferric sulfate, ferrous sulfate, lithium sulfate, or aluminum sulfate.

16. The method according to claim 12, wherein forming the hot-dip galvanized layer comprises a plating treatment comprising:

a first step of degreasing;

a second step of water washing;

a third step of acid cleaning;

a fourth step of water washing;

a fifth step of flux treatment;

a sixth step of galvanization; and a seventh step of cooling.

17. The method according to claim 12, wherein the sulfate salt content of the hot-dip galvanized layer is 0.016 to 0.066 mol based on 100 g of the zinc.

18. The method according to claim 12, wherein the hot-dip galvanized layer consists of the zinc and the sulfate salt.

19. The method according to claim 12, wherein the hot-dip galvanized layer consists of the zinc, aluminum, and the sulfate salt.

20. The method according to claim 12, wherein the hot-dip galvanized layer consists of the zinc, magnesium, and the sulfate salt.

* * * * *